US008371942B2

(12) United States Patent
Finnimore et al.

(10) Patent No.: US 8,371,942 B2
(45) **Date of Patent: *Feb. 12, 2013**

(54) SYSTEM FOR MANAGING GAMING DEVICES

(75) Inventors: Ian Finnimore, Sparks, NV (US); Joseph J. Davis, Sr., Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/366,533

(22) Filed: Feb. 6, 2012

(65) Prior Publication Data

US 2012/0135801 A1 May 31, 2012

Related U.S. Application Data

(63) Continuation of application No. 11/934,036, filed on Nov. 1, 2007, now Pat. No. 8,113,956.

(51) Int. Cl.
*A63F 9/24* (2006.01)

(52) U.S. Cl. ..... 463/42; 463/29; 463/40; 463/41

(58) Field of Classification Search ..... 463/25, 463/29, 40–42

See application file for complete search history.

(56) References Cited

U.S. PATENT DOCUMENTS

| | | | | |
|---|---|---|---|---|
| 4,335,809 | A * | 6/1982 | Wain | 463/20 |
| 5,575,717 | A * | 11/1996 | Houriet et al. | 463/1 |
| 5,956,487 | A * | 9/1999 | Venkatraman et al. | 709/218 |
| 6,884,173 | B2 * | 4/2005 | Gauselmann | 463/42 |
| 7,311,601 | B2 * | 12/2007 | Anderson et al. | 463/20 |
| 7,399,229 | B2 * | 7/2008 | Rowe | 463/42 |
| 2003/0109308 | A1 * | 6/2003 | Rowe | 463/42 |
| 2004/0166940 | A1 * | 8/2004 | Rothschild | 463/42 |
| 2005/0227769 | A1 * | 10/2005 | Morrow et al. | 463/42 |
| 2006/0068906 | A1 * | 3/2006 | Morrow et al. | 463/30 |
| 2006/0264256 | A1 * | 11/2006 | Gagner et al. | 463/20 |

* cited by examiner

*Primary Examiner* — Dmitry Suhol
*Assistant Examiner* — David Duffy
(74) *Attorney, Agent, or Firm* — Brooke Quist; Marvin Hein

(57) ABSTRACT

An embedded web server is disclosed. In one embodiment, a casino gaming system comprises a back-end system having one or more servers. One or more gaming machines are operatively connected to the back-end system via a network connection, and one or more gaming devices are operatively connected to at least one gaming machine. The gaming device includes an embedded web server and a web browser in communication with the web server, and delivers a management user interface to the web browser for accessing the gaming device.

13 Claims, 3 Drawing Sheets

SYSTEM FOR MANAGING GAMING DEVICES

CROSS REFERENCE TO RELATED APPLICATIONS

This application is a continuation of U.S. patent application Ser. No. 11/934,036 filed Nov. 1, 2007, now U.S. Pat. No. 8,113,956,entitled SYSTEM FOR MANAGING GAMING DEVICES, which is hereby incorporated herein in its entirety by reference. U.S. patent application Ser. No. 11/934,036 is also related to U.S. patent application Ser. No. 11/934,039, filed Nov. 1, 2007 now U.S. Pat. No. 8,088,009.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE DISCLOSURE

This disclosure relates to a casino gaming system, and more particularly, to a system for managing gaming devices in a casino gaming system.

BACKGROUND

Traditionally, gaming machines have been designed for gaming purposes only. In this regard, gaming machines have been constructed to only include gaming functionality. However, casino owners have become aware of additional features that may be incorporated into gaming machines and casino gaming systems to aid in the management and control of gaming functions. Accordingly, casinos have employed a variety of systems to monitor and manage casino gaming systems. For example, gaming machines are typically connected to a back-end system via a casino network. The back-end system is configured to collect data from the casino floor as communicated to it from other network components, and maintain the collected data in its database. The back-end system may store data, pass data to another server for other functions, and pass data to casino floor hardware for interaction with a game or game player.

The various gaming components and gaming devices within the gaming machine may also communicate to the back-end system and to internal display devices via a proprietary data protocol or direct control. Typically, all communication to the various gaming components and gaming devices is routed through the back-end system. Current systems do not provide for direct communication to gaming devices without intervention from the back-end system.

SUMMARY

Briefly, and in general terms, various embodiments are directed to a system for managing gaming devices in a casino gaming system. One embodiment provides a casino gaming system including a plurality of gaming machines, a plurality of gaming components, and a plurality of web browsers. The plurality of gaming components are included as part of each gaming machine. At least two gaming components are enhanced gaming components, and the enhanced gaming components each include an embedded web server. The plurality of web browsers are associated with each of the plurality of gaming machines. The web browsers are on external clients. Each embedded web server delivers a unique management user interface to the web browsers that includes instructions for managing an enhanced gaming component of the plurality of gaming components.

Another embodiment is directed to a casino gaming system that includes a plurality of gaming machines, one or more web servers, and a plurality of web browsers. The plurality of gaming machines each include one or more gaming components. A web server is embedded in each gaming component. A plurality of web browsers are associated with each of the plurality of gaming machines. The web browsers are on external clients. The web browsers receive input via the unique management user interface that includes instructions for managing a gaming component.

Another embodiment is directed to a gaming device management system for managing gaming components of a gaming machine. The gaming device management system includes a plurality of gaming components, a plurality of web browsers, and a unique management user interface. The plurality of gaming components are included in a gaming machine. Two or more of the gaming components include an embedded web server. The plurality of web browsers are associated with each of a plurality of gaming machines. The web browsers are on external clients. The unique management user interface is delivered to each web browser from an embedded web server and associated gaming component. Each web browser is configured to receive input via the unique management user interface that includes instructions for managing a gaming component of the plurality of gaming components.

Other features and advantages will become apparent from the following detailed description, taken in conjunction with the accompanying drawings, which illustrate by way of example, the features of the various embodiments.

DETAILED DESCRIPTION

Figure 1:
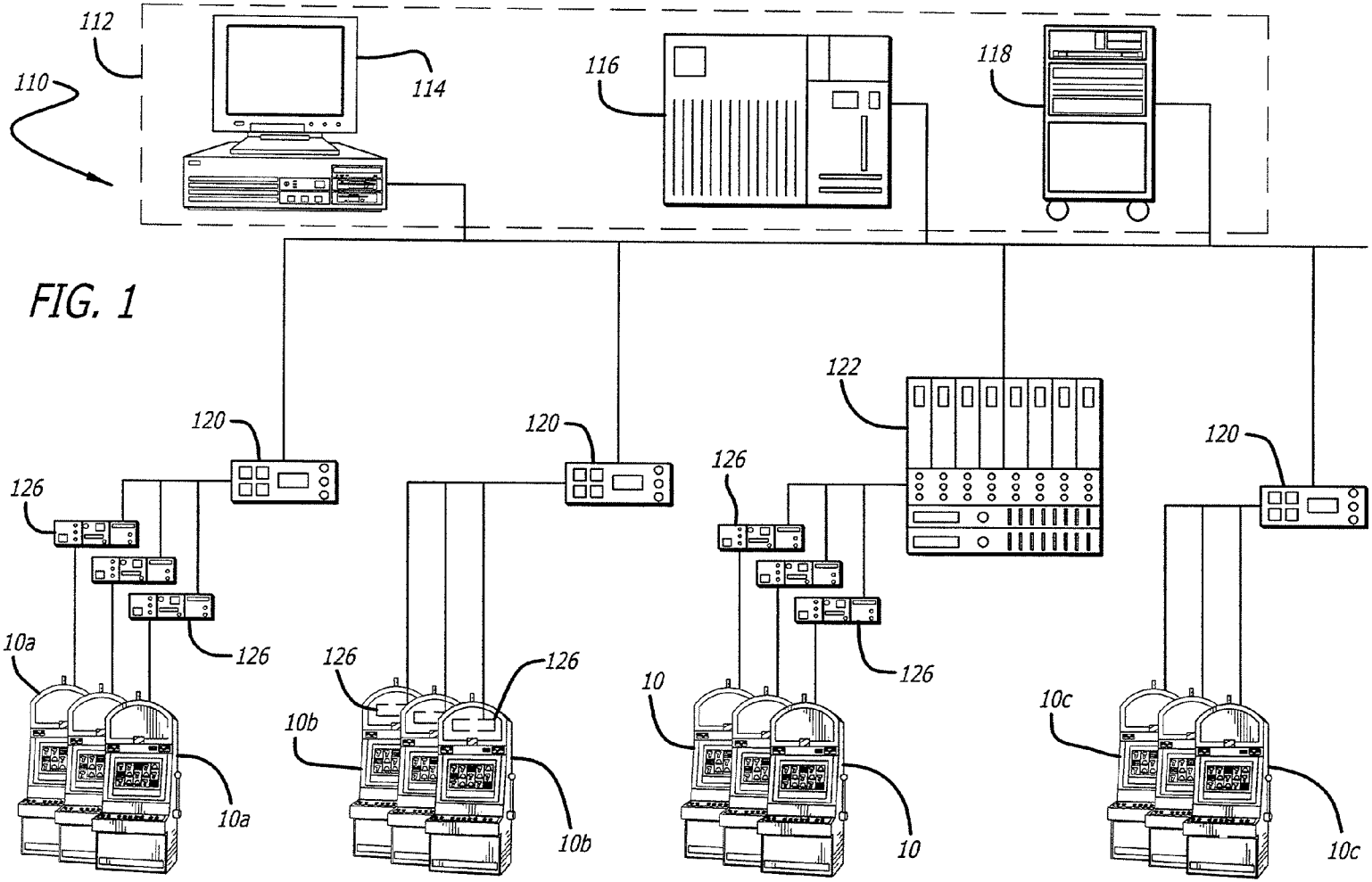
FIG. 1 is a schematic illustration of a casino gaming system for use in accordance with an embodiment of the embedded web server.

The present system and method are directed to the management of a casino gaming system. More particularly, the present system and method provide for the management of devices and/or gaming components in the casino gaming system. Various embodiments are directed to embedding a web server into one or more devices or components in the casino gaming system, wherein the embedded web server delivers a management user interface to a standard web browser. The management user interface may be accessed, via a web browser, by a user (such as a casino technician or operator) to manage the device having the embedded web server. In various embodiments, a gaming device comprising an embedded web server is referred to as an enhanced gaming device. Likewise, a gaming component including an embedded web server is referred to as an enhanced gaming component. Further, neither the enhanced gaming device nor the enhanced gaming component, interfere with the normal gaming hardware in a gaming machine or on the casino gaming system, but rather are smoothly integrated into the system.

The embedded web server allows enhanced gaming devices to be accessed with standard protocols where the accessed device can present its own user interface elements and can receive and respond to inquiries. More particularly, the embedded web server includes software that services HTTP (HyperText Transport Protocol) requests. The embedded web server manages requests from a web browser and delivers HTML (HyperText Markup Language) documents and files in response. It also executes server-side processing methods such as, but not limited to, CGI scripts (Common Gateway Interface scripts), JSPs (JavaServer Pages), and ASPs (Active Server Pages), that provide various functions such as database searching.

Additionally, since the enhanced gaming device can support web browsing technology as a supplement to its web server, the enhanced gaming devices can communicate between themselves with no back-end server intervention. In one embodiment, the gaming devices communicate via a TCP/IP network. However, those skilled in the art will appreciate that other communication methodologies may be used. In one embodiment, each embedded web server is assigned a unique IP address (Internet Protocol address) and a web browser communicates with the embedded web servers via the TCP/IP protocol. The browser sends HTTP requests to the server, which responds with HTML pages and possibly additional programs in the form of ActiveX controls or Java applets.

Referring now to the drawings, wherein like reference numerals denote like or corresponding parts throughout the drawings and, more particularly to FIGS. 1-4, there are shown various embodiments of an embedded web server incorporated into a casino gaming system.

Referring to FIG. 1, one example embodiment of a casino gaming system 110 is illustrated. The casino gaming system 110 comprises one or more gaming machines 10 operatively connected via a network to a back-end system 112. The back-end system 112 may be configured to comprise one or more servers. The type of server employed is generally determined by the platform and software requirements of the gaming system. In one example embodiment, as illustrated in FIG. 1, the back-end system 112 is configured to include three servers: a casino floor controller 114, a casino management server 116 and a casino database 118. The casino floor controller 114 is a part of the player tracking system for gathering accounting, security and player specific information. The casino management server 116 and casino database 118 work together to store and process information specific to both employees and players. Player specific information includes, but is not limited to, passwords, biometric identification, player card identification, and biographic data. Additionally, employee specification information may include biographic data, biometric information, job level and rank, passwords, authorization codes and security clearance levels.

Overall, the back-end system 112 performs several fundamental functions. For example, the back-end system 112 can collect data from the casino floor as communicated to it from other network components, and maintain the collected data in its database. The back-end system 112 may use casino floor data to generate a report used in casino operation functions. Examples of such reports include, but are not limited to, accounting reports, security reports, and usage reports. The back-end system 112 may also pass data to another server for other functions. Alternatively, the back-end system 112 may pass data stored on its database to floor hardware for interaction with a game or game player. For example, data such as a game player's name or the amount of a ticket being redeemed at a game may be passed to the floor hardware. Additionally, the back-end system 112 may comprise one or more data repositories for storing data. Examples of types of data stored in the system server data repositories include, but are not limited to, information relating to individual player play data, individual game accounting data, gaming machine accounting data, cashable ticket data, and sound data including optimum audio outputs for various casino settings.

The network bridges 120 and network rack 122 are networking components used for networking, routing and polling gaming machines 10. In one embodiment, the gaming machines 10 are connected via a network to a network bridge 120, and the network bridge 120 connects to a back-end system 112. Optionally, the gaming machines 10 may connect to the network via a network rack 122, which provides for a fewer number of connections to the back-end system 112. Both network bridge 120 and network rack 122 may be classified as middleware, and facilitate communications between the back-end system 112 and the gaming machines 10. The network bridges 120 and network rack 122 may comprise data repositories for storing network performance data. Such performance data may be based on network traffic and other network related information. Optionally, the network bridge 120 and the network rack 122 may be interchangeable components. For example, in one embodiment, a casino gaming system may comprise only network bridges and no network racks. Alternatively, in another embodiment, a casino gaming system may comprise only network racks and no network bridges. Additionally, in an alternative embodiment, a casino gaming system may comprise any combination of one or more network bridges and one or more network racks.

In one embodiment, a web server may be embedded into one or more networking components. For example, in one embodiment, a network bridge 120 may also include an embedded web server (not shown). The embedded web server is configured to deliver web pages, including a management user interface to a web browser. In one example embodiment, web server software is embedded in the network bridge 120, and access to the software is allowed, via a web browser, for configuring the network bridge 120 or obtaining reports. Optionally, in another embodiment, a network rack 122 may incorporate an embedded web server, wherein the embedded web server delivers web pages, including a management user interface, to a web browser.

Game monitoring units (GMUs) 126 connect gaming devices, such as gaming machines 10, to networking components (e.g., network bridges, network racks, and the like). The GMUs may be installed within the gaming machine cabinet or may be located external to the gaming machine 10. In one embodiment, the GMU 126 is a separate component located outside the gaming machine 10*a*. Alternatively, in another embodiment, the GMU 126 is located within the gaming machine 10*b*. Optionally, in an alternative embodiment, one or more gaming devices 10*c* connect directly to a network and are not connected to a GMU 126.

A GMU 126 is a device connected to the circuitry of a gaming machine 10 that monitors the game, coin status, player winnings, and/or the gaming machine. The GMU 126 sends the monitored information to a server on the back-end system 112 for processing. Additionally, the GMU 126 may record gaming machine operation and transfer the information to the back-end system 112. Those skilled in the art will appreciate that the functionality of the GMUs 126 may vary, and that the GMU 126 may be configured to perform additional tasks. Some GMUs 126 have much greater capability and can perform such tasks as presenting and playing a game using a display (not shown) operatively connected to the GMU 126.

Optionally, in one embodiment, a web server is embedded into one or more of the GMUs 126. The embedded web server is configured to deliver web pages, including a management user interface to a web browser. The management user interface allows a user to configure and control various management functions, such as, but not limited to, changing settings for the GMU 126, obtaining diagnostic real-time current values, reviewing and obtaining current meter values, and the like. Additionally, in one embodiment, a user can input configuration changes for the GMU 126 via the management user interface. The configuration changes take effect immediately upon confirmation.

The gaming machines 10 act as terminals for interacting with a player playing a casino game. In various embodiments, any of the gaming machines 10 may be any type of electronic or mechanical gaming devices, such as, but not limited to, a mechanical reel spinning slot machine, video slot machine, video poker machine, keno machine, video blackjack machine, or a gaming machine offering one or more of the above-described games. Examples include, but are not limited to, the S6000 mechanical reel spinner and the Alpha video slot machine from Bally Gaming, Inc.

Additionally, one or more of the gaming machines 10 may comprise one or more data repositories (not shown) for storing data. Examples of information stored by the gaming machines 10 include, but are not limited to, accounting data, maintenance history information, short and/or long-term play data, real-time play data, sound data, celebration activity data, and triggering events data. The sound data may include, but is not limited to, audio files, sound clips, way files, mp3 files and sound files saved in various other formats. Furthermore, each gaming machine 10 comprises an audio system for outputting sound.

In one embodiment, a web server is embedded within a gaming machine 10. More particularly, in one embodiment, a web server set of code is embedded within the gaming machine 10. Additionally, in another embodiment, a web server is embedded within a device of the gaming machine 10, wherein the device also includes a processor.

Figure 2:
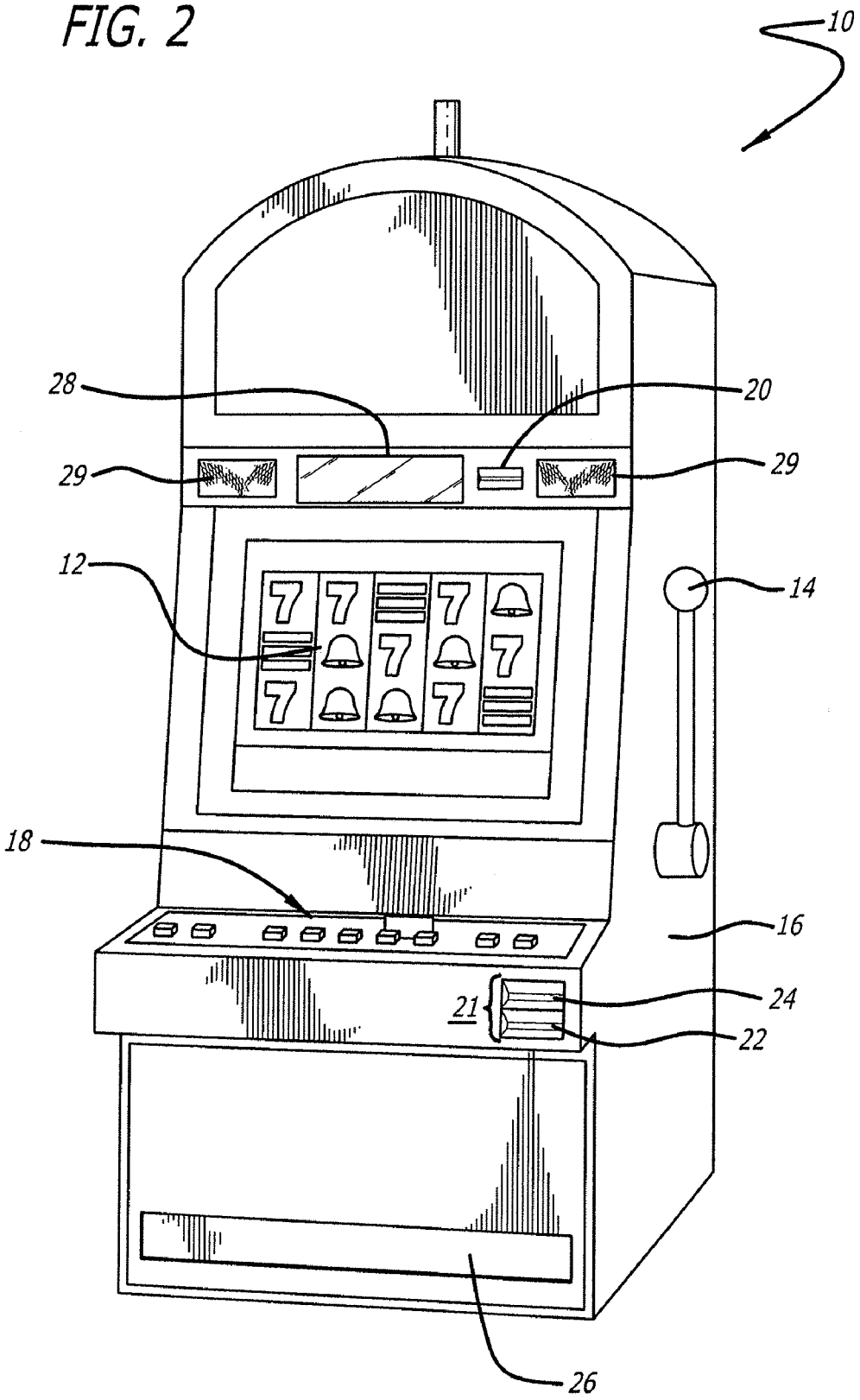
FIG. 2 is an example embodiment of a gaming machine for use with an embodiment of the embedded web server.

Referring to FIG. 2, an example embodiment of a gaming machine 10 is illustrated. The gaming machine 10 includes a display 12. In one embodiment, the display 12 is a viewing area that displays a plurality of mechanical reels for presenting a slot-style game. Alternately, the display 12 is a video display for presenting one or more games such as, but not limited to, mechanical slots, video slots, video poker, video blackjack, video keno, video roulette, Class II bingo, games of skill, games of chance involving various levels of player skill, or any combination thereof.

Optionally, in some embodiments, the display 12 is a video display such as, but not limited to, a CRT (cathode ray tube), or a thin-panel display. Examples of thin-panel displays include plasma, LCD (liquid crystal display), electroluminescent, vacuum fluorescent, field emission, LCOS (liquid crystal on silicon), and SXRD (Silicon Xtal Reflective display) or any other types of panel displays known or developed in the art. These flat panel displays may use panel technologies to provide digital quality images including by way of example only, and not by way of limitation, EDTV, HDTV, or DLP (Digital Light Processing). Additionally, the display 12 may be mounted in the gaming cabinet in either a portrait or landscape orientation. Optionally, the game display 12 may also include a touch screen or touch glass system (not shown). The touch screen allows a user to input information. The touch screen may be used in place of mechanical buttons, or alternately the touch screen may be used to supplement other input devices, such as buttons.

Additionally, in one embodiment a video controller (not shown) manages and controls the operation of various functions of the video display 12. In one optional embodiment, the video controller includes an embedded web server configured to deliver web pages, including a management user interface to a web browser.

The main cabinet 16 of the gaming machine 10 is a self-standing unit that is generally rectangular in shape. Alternatively, in other embodiments, the gaming cabinet may be a slant-top gaming cabinet or any shaped cabinet known or developed in the art. However, any shaped cabinet may be used with any embodiment of the gaming machine 10 and sized for a player to be able to sit or stand while playing a game. Additionally, the cabinet 16 may be manufactured with reinforced steel or other rigid materials that are resistant to tampering and vandalism.

The gaming machine 10 includes one or more input mechanisms. In one embodiment, the gaming machine 10 may include a plurality of player-activated buttons 18, which may be used for numerous functions such as, but not limited to, selecting a wager denomination, selecting a number of games to be played, selecting a wager amount per game, initiating a game, or cashing out money from the gaming machine 10. The buttons 18 function as input mechanisms and may include mechanical buttons, electromechanical buttons or touch screen buttons. Optionally, handle 14 may also serve as an input mechanism. More particularly, the handle 14 may be "pulled" by a player to initiate a game. Additionally, one or more of the player-activated buttons 18 may be used as an interface mechanism in conjunction with the player selection of a denomination for a game linked to a progressive jackpot.

In another embodiment, one input mechanism is a universal button module (not shown) that provides a dynamic button system adaptable for use with various games, as disclosed in U.S. application Ser. No. 11/106,212, entitled "Universal Button Module," filed Apr. 14, 2005 and U.S. application Ser. No. 11/223,364, entitled "Universal Button Module," filed Sep. 9, 2005, which are both hereby incorporated by reference. Additionally, other input devices, such as but not limited to, a touch pad, a track ball, a mouse, switches, and toggle switches, are included with the gaming machine to also accept player input. In another embodiment, the input device used by the gaming machine 10 further includes a processor (not shown) and an embedded web server (not shown). The web server delivers a management user interface to a web browser. A user, such as a casino operator or technician, may manage and control the input device via the management user interface.

In one embodiment, the main cabinet 16 houses a main gaming machine processor (not shown) that includes a CPU, circuitry, and software for receiving signals from the player-activated buttons 18 and a handle 14, operating the games, and transmitting signals to the respective game display 12 and speakers 29. Alternately, in an optional embodiment, the game management unit is housed outside of the main cabinet but is operatively connected to the gaming machine 10. Optionally, in an alternate embodiment, the main gaming machine processor includes an embedded web server that delivers a management user interface to a web browser. Various features of the main gaming machine processor may be controlled and configured via the management user interface.

The gaming machine 10 may also include one or more speakers 29. Various types of audio may be output to the speakers 29. The speakers 29 may be operatively connected to an amplifier (not shown). Alternately, the speakers 29 may be self-amplified. Optionally, the speakers 29 may be component speakers with a separate tweeter, midrange, and subwoofer to provide better sound imaging to the gaming machine patron. In yet another embodiment, the speakers 29 may be full-range speakers (e.g., two-way, three-way or 4-way speakers). Optionally, various audio files for use with one or more audio features may be stored on the gaming machine 10.

Optionally, in one embodiment, the speakers 29 include a processor and an embedded web server. The web server is configured to deliver a management user interface to a web browser. The management user interface may be accessed in order to control various features and functions of the speakers 29.

In various embodiments, the gaming machine 10 shown may also include a ticket reader/ticket printer system 21 that is associated with a cashless gaming system. In one embodiment, the ticket reader/ticket printer system provides separate slots for performing various functions. More particularly, a slot 24 is provided to accept and read tickets. Additionally, a slot 22 is provided to print out and/or issue tickets. In one embodiment, the ticket reader (i.e., slot 24) of a cashless gaming system is capable of accepting previously printed vouchers, paper currency, promotional coupons, or the like. The ticket printer (i.e., slot 22) of the cashless gaming system generates vouchers having printed information that includes, but is not limited to, the value of the voucher (i.e., cash-out amount) and a barcode that identifies the voucher.

Optionally, in an alternate embodiment, a single slot (not shown) is used to accept and issue tickets. Tickets may be inserted into the single slot and read. Additionally, tickets may be issued from, or printed from, the same single slot.

Additionally, in an optional embodiment the ticket reader/ticket printer system 21 further includes a processor and an embedded web server. The embedded web server delivers a management user interface to a web browser. As discussed above, the management user interface may be accessed to control and configure various features and functions associated with the enhanced device (i.e., the ticket reader/ticket printer system 21). More particularly, in one embodiment, only the ticket printer 22 includes an embedded web server. The ticket printer 22 includes a processor that delivers web pages to one or more web browsers. Alternately, in another embodiment, only the ticket reader 24 includes an embedded web server. Similarly, the enhanced ticket reader 24 includes a processor. Optionally, in an alternate embodiment, both the ticket printer 22 and the ticket reader 24 include an embedded web server.

Optionally, in an alternate embodiment, the ticket reader/ticket printer system 21 includes a bill acceptor, which is an assembly that examines currency or coupons and communicates the value to the machine. Accepted items register as credits, rejected items are returned to the player. In one optional embodiment, the slot 24 works in conjunction with a bill acceptor assembly. Alternately, in an optional embodiment, the gaming machine 10 includes a separate bill acceptor (not shown). In one embodiment, the bill acceptor device may include an embedded web server that delivers a management user interface to a web browser. The management user interface may be used to control and configure various functions and operations of the bill acceptor.

The gaming machine 10 may further include a player tracking system (not shown). The player tracking system allows a casino to monitor the gaming activities of various players. Additionally, the player tracking system is able to store data relating to a player's gaming habits. That is, a player can accrue player points that depend upon the amount and frequency of their wagers. Casinos can use these player points to compensate the loyal patronage of players. For example, casinos may award or "comp" a player free meals, room accommodations, tickets to shows, and invitations to casino events and promotional affairs.

Typically, the player tracking system is operatively connected to one or more input components on the gaming machine 10. These input components include, but are not limited to, a card reader for receiving a player tracking card, a keypad or equivalent, an electronic button receptor, a touch screen and the like. The player tracking system may also include a database of all qualified players (i.e., those players who have enrolled in a player rating or point accruing program). Generally, the database for the player tracking system is separate from the gaming devices.

The gaming machine 10 includes a card reader 20 that may be used to read player tracking cards. Additionally, the card reader 20 may also read casino employee cards. Each time a card is inserted into the reader, it monitors and tracks player and employee activity. In one embodiment, the card reader 20 may include an embedded web server that delivers a management user interface to a web browser. The management user interface may be used to control and configure various functions and operations of the card reader 20.

Further, the casino gaming system 110 of FIG. 1 may include one or more machine processing units (MPUs) which are circuitry that contain a microprocessor and memory, an input/output interface, a buffer, a clock, and driver circuits. Optionally, in one embodiment, the MPU includes an embedded web server capable of delivering a management user interface to a web browser. The management user interface is used to control and manage the accessed MPU.

Optionally, the casino gaming system 110 may include one or more iView devices as disclosed in U.S. application Ser. No. 10/943,771, entitled "User Interface System and Method for a Gaming Machine," filed Sep. 16, 2004, now U.S. Pat. No. 7,950,999, issued May 5, 2011. In one embodiment, an iView device includes a touch-screen display that combines the keypad and LCD display of an enhanced player interface. The iView device consists of a display screen and iView board, which connect directly to the GMU 126 using a standard I2C bus cable. Additionally, in one embodiment, a web server is embedded in the iView device. The web server delivers a management user interface to a web browser, which allows for controls and management of the iView device.

In various embodiments, the casino gaming system 110 includes one or more overhead signage controllers (not shown). The overhead signage controllers control the operation and function of display signs. Typically, the display signs are digital display screens (such as a plasma display, LCD display, and the like), strategically placed in the casino for player viewing. The signs may indicate jackpot awards, advertisements, and other information. In one embodiment, a web server is embedded in the overhead signage controller. The web server delivers a management user interface to a web browser, which allows for control and management of the various signs/display screen connected to the overhead signage controller.

The casino gaming system 110 may further employ various game controllers throughout the system. Generally, a game controller is a combination of hardware and software that supports a game for a group or bank of player terminals. Controller functions include but are not limited to: installation, setup and configuration of the game application; status of client and subscription lists, and storage; setups for attendant, network, and terminals, and access to snapshots. Examples of different types of controllers configured to support games include, but are not limited to, a Lottery Game Controller (LGC), Bingo Game Controller (BGC), Remote Game Controller (RGC), and Progressive Game Controller (PGC).

In various embodiments, a web server may be embedded into one or more game controllers. The embedded web server delivers a management user interface to a web browser. The management functions of the enhanced game controlled may be accessed and controlled via the management user interface.

In an optional embodiment, the casino gaming system 110 includes at least one web server embedded in a gaming peripheral device (not shown). The gaming peripheral device may be any peripheral device connected externally or internally to the casino gaming system. In one embodiment, the gaming peripheral device may be connected internally or externally to a gaming machine 10. Further, the embedded web server in the gaming peripheral device delivers web pages to a web browser, including a management user interface. A user may access the management user interface and may input instructions to control and configure the gaming peripheral device.

One of ordinary skill in the art will appreciate that the casino gaming system 110 may not have all the components and devices described above, and that the casino gaming system may have other components in addition to, or in lieu of, those devices/components mentioned here. Furthermore, while these devices are viewed and described separately, various components may be integrated into a single unit in some embodiments.

Optionally, one of ordinary skill in the art will appreciate that an embedded web server may be incorporated into any of the devices in the casino gaming system, as long as the device includes at least a processor capable of delivering web page content to a web browser. The management user interface is used to access and control an enhanced gaming device having an embedded web server. Additionally, multiple embedded web servers may be incorporated into a casino gaming system, and the multiple embedded web servers may communicate directly to each other.

Figure 3:
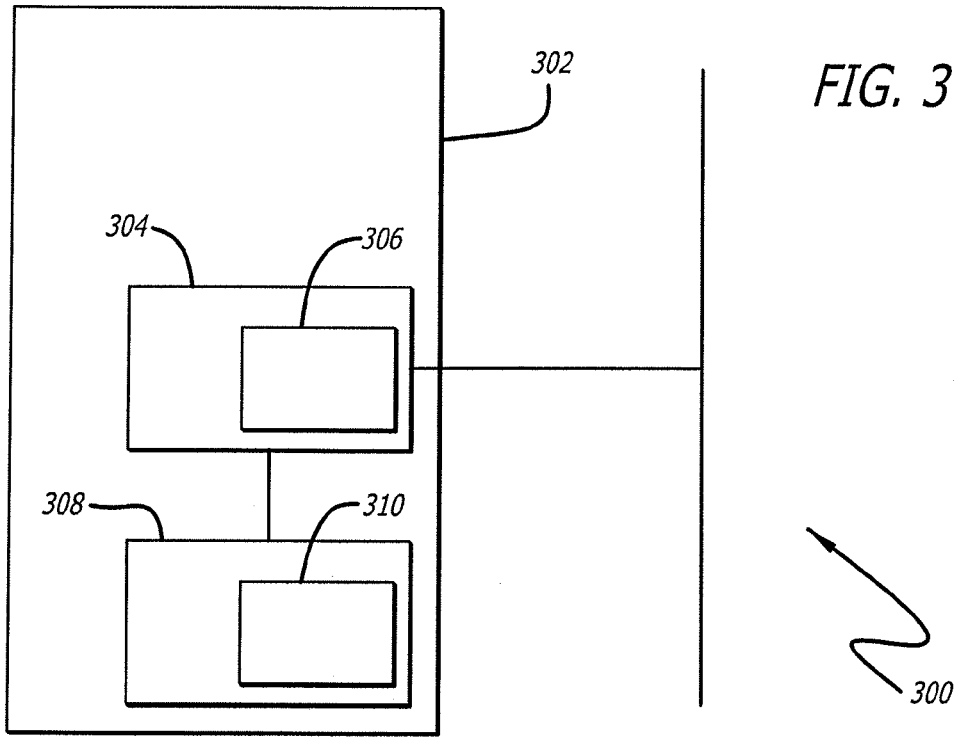
FIG. 3 is a component diagram of a gaming machine incorporating an embedded web server.

Referring now to FIG. 3, a gaming machine 302 in a casino gaming system 300 is illustrated. The gaming machine 302 comprises a gaming device 304 and a gaming device 308. The gaming devices 304 and 308 can include a variety of gaming devices found in a casino gaming system 300, as described above, and for example including, but not limited to, GMUs, MPUs, input mechanisms, ticket readers, ticket printers, bill acceptors, card readers, and game controllers. In one example embodiment, the gaming device 304 is a GMU 304. Additionally, the GMU 304 includes an embedded web server 306. Additionally, in an optional embodiment, the gaming machine 302 may include additional enhanced gaming devices (meaning gaming devices having an embedded web server). For example, in one embodiment, the gaming machine 302 includes a gaming device 308. In one embodiment the gaming device 308 is an MPU. The gaming device 308 includes an embedded web server 306. In one embodiment, the gaming devices 304 and 308 are connected via a standard network connection which may include a network connection, including but not limited to, a local area network connection, a TCP/IP connection, a wireless connection, or any other means for operatively networking components together. Additionally, the gaming devices 304 and 308 are connected via a network to a back-end system.

Further, the embedded web serving capability allows the gaming devices 304 and 308 to be accessed with standard protocols, where the accessed device can present its own user interface elements and can receive and respond to inquiries. The management user interface generated by a web server may be configured to be unique to each type of gaming device. Further, the integration of the web server within the gaming device provides for direct access to the gaming device without the need for a specialized client application.

Figure 4:
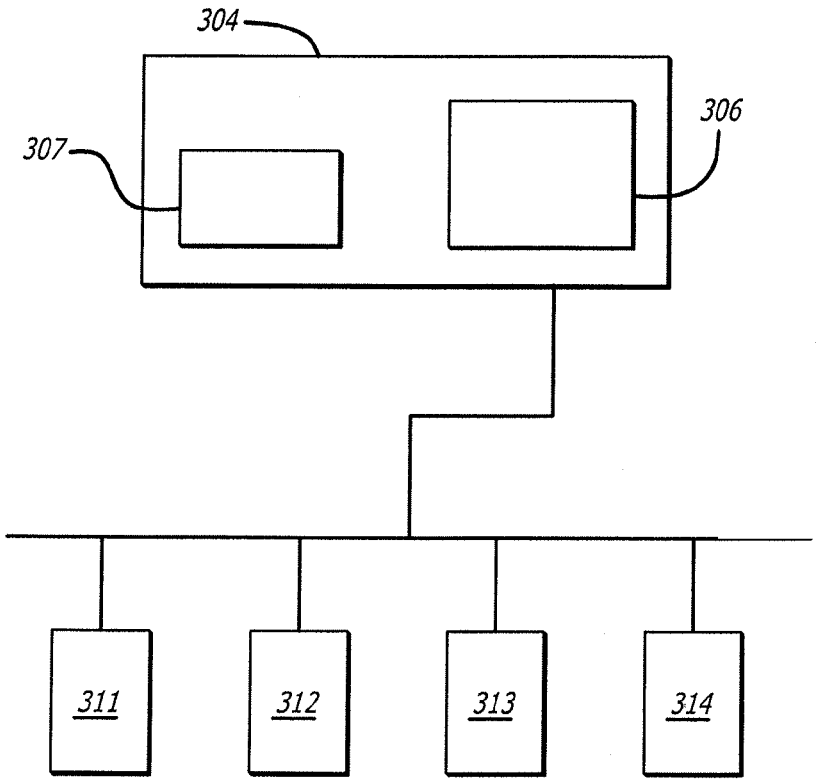
FIG. 4 is a component diagram illustrating a plurality of clients that can access an embedded web server.

FIG. 4 illustrates a plurality of clients that may access an embedded web server. More particularly, the GMU 304 includes an embedded web server 306. In one embodiment, the web server 306 delivers web content pages to a web browser 311 (client 311). Additionally, the web server 304 may deliver static or dynamic content. In one embodiment, the web browser 311 is located on an external client PC. Optionally, in an alternate embodiment, the web server 306 delivers web pages to a hand-held mobile web browser 312 (client 312). Additionally, in an optional embodiment, the web server may deliver web content pages to a back-end server program 313 (client 313). Further, in an alternate embodiment, the web server 306 may deliver web content to embedded web page display device 314 (client 314), which may be located anywhere on a casino gaming system.

In one example embodiment, a user (such as a casino operator or casino technician) may access the web server 306 via the web browser 311. In one embodiment, an IP address is assigned to each web server. The user enters the particular web address for the web server 306. Through a network connection, such as an internet connection, the web browser 311 initiates a connection to the web server 306. The web server stores information and files necessary to display particular pages of information on the web browser 311. Once the web server 306 receives a request, it delivers the requested data back to the web browser 311. The web browser 311 in turn converts, or formats, the computer languages of the received files and displays the received information on the web browser's display.

Using the displayed management user interface, the casino operator may perform various management tasks. In one example embodiment, such tasks may include, but are not limited to, monitoring current meter values with automatic timely refreshes, remote configuration of the GMU, wherein changes in the settings are effective immediately upon confirmation, viewing what is currently displayed on the in-game display and state information.

Additionally, in an alternate embodiment, the management functionality does not permit reconfiguration of the gaming device, such as the GMU 304. Rather, the management user interface may be used only to inspect the GMU 304.

In an alternate embodiment, system-managed configuration inspection and diagnostics are allowed by an automatic client interrogation of the GMU device, wherein the responses are then stored and/or analyzed. The casino gaming system embeds a link to the GMU management page within the stored file, thereby allowing the management screens to directly link to the web page served up by the GMU embedded web server 306. Optionally, another management function provided by the system includes fault analyses and resolution of transaction based events, such as ticket or cashless transactions that failed to complete. Additionally, in one embodiment, the management functionality further includes event journaling of current events (including player-related events) on the gaming device, such as the GMU 304.

In one embodiment, the web server 306 is restricted in features. For example, the web server 306 may be configured to support only standard HTTP "GET" and "PUT" requests. Additionally, in another embodiment, management screens are generated on the fly by the GMU based upon the URL requested. Further, in one embodiment, management functions such as settings changes and diagnostic, real-time, current values are allowed.

Authentication at the GMU may be accomplished via standard authentication methods known to those skilled in the art. For example, an employee identification card number may be transmitted via the URL Query string or through a HTTP "PUT" message. This employee identification is transmitted back via the normal channels to a back-end system, and more particularly to a back-end Slot Management System (SMS) for authentication. In this example, the authentication occurs in the same manner as when an employee inserts her identification card into the game. The SMS system verifies the employee identity and authority to manage the GMU device remotely, and responds with a message or acknowledgement that indicates success. Alternately, the SMS system may also respond with a message indicating denied access.

Referring back to FIG. 4, the web server 306 may deliver web content pages to a hand-held mobile web browser 312 (client 313). The hand-held mobile web browser allows a casino operator to remotely configure and access gaming devices in a casino. Additionally, remotely accessing the gaming devices provides for less game play interruption. For example, a casino player does not have to move out of the way in order for a casino operator to access a gaming device. Rather the casino operator may access the gaming device remotely via the hand-held mobile web browser. Optionally, in other embodiments the casino operator may access a gaming device remotely via an web browser.

The various embodiments described above are provided by way of illustration only and should not be construed to limit the claimed invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed:

1. A casino gaming system comprising:

a plurality of gaming machines;

a plurality of gaming components included as part of each gaming machine, wherein at least two gaming components are enhanced gaming components, and the enhanced gaming components each include an embedded web server; and a plurality of web browsers associated with each of the plurality of gaming machines, wherein the web browsers are on external clients, wherein each embedded web server delivers a unique management user interface to the web browsers for accessing each gaming component that has an embedded web server, and wherein the web browsers receive input via the unique management user interface that includes instructions for managing a first gaming component of the plurality of gaming components in which a first web server is embedded.

2. The casino gaming system of claim 1, further comprising an external computer comprising a display, wherein a web browser is presented on the display.

3. The casino gaming system of claim 1, further comprising a hand-held mobile web browser for receiving the management user interface delivered by an embedded web server via a wireless interface.

4. The casino gaming system of claim 1, further comprising an embedded web page display device, wherein a web browser is presented on a display device.

5. The casino gaming system of claim 1, wherein the gaming component is a network rack, network bridge, gaming machine, game monitoring unit, video controller, player input mechanism, ticket reader, ticket printer, bill acceptor device, card reader, machine processing unit, overhead signage controller, or game controller.

6. A casino gaming system comprising:

a gaming machine that includes two or more gaming components;

a web server embedded in each gaming component; and a plurality of web browsers associated with the gaming machine, wherein the web browsers are on external clients, wherein the web browsers are configured to display a unique management user interface generated by each embedded web server, wherein each unique management user interface allows for access to a particular gaming component, and wherein the web browsers receive input via the unique management user interface that includes instructions for managing a first gaming component of the plurality of gaming components.

7. The casino gaming system of claim 6, further comprising an external computer having a display, wherein a web browser is presented on the display.

8. The casino gaming system of claim 6, further comprising an embedded web page display device, wherein a web browser is presented on a display device.

9. The casino gaming system of claim 6, further comprising a hand-held mobile device for interfacing wirelessly with the embedded web servers, and wherein a web browser is displayed on the hand-held mobile device.

10. The casino gaming system of claim 6, wherein the gaming component having an embedded web server is a network rack, network bridge, gaming machine, game monitoring unit, video controller, player input mechanism, ticket reader, ticket printer, bill acceptor device, card reader, machine processing unit, overhead signage controller, or game controller.

11. The casino gaming system of claim 6, wherein the network connection is a wireless connection.

12. A gaming component management system for managing gaming components of a gaming machine, comprising:

a plurality of gaming components that are included in a gaming machine, wherein two or more of the gaming components include an embedded web server;

a plurality of web browsers associated with each of a plurality of gaming components, wherein the web browsers are on external clients; and a unique management user interface, wherein the unique management user interface is delivered to each web browser from an embedded web server and associated gaming component, wherein each unique management user interface provides access for managing the gaming component, and wherein each web browser is configured to receive input via the unique management user interface that includes instructions for managing a first gaming component of the plurality of gaming components.

13. The gaming device management system of claim 12, wherein the gaming component is a network rack, network bridge, gaming machine, game monitoring unit, video controller, player input mechanism, ticket reader, ticket printer, bill acceptor device, card reader, machine processing unit, overhead signage controller, or game controller.

* * * * *